US007854419B2

(12) United States Patent
Ng et al.

(10) Patent No.: US 7,854,419 B2
(45) Date of Patent: Dec. 21, 2010

(54) ADJUSTABLE MOUNTING BRACKET FOR ROLLER BLIND

(76) Inventors: Philip Ng, 25 White Blvd., Thornhill (CA) L4J 5Z4; Norman Wills, 1660 Woodheng Way, Mississauga (CA) L5N 7T2

( * ) Notice: Subject to any disclaimer, the term of this patent is extended or adjusted under 35 U.S.C. 154(b) by 384 days.

(21) Appl. No.: 11/956,449

(22) Filed: Dec. 14, 2007

(65) Prior Publication Data

US 2009/0152422 A1 Jun. 18, 2009

(51) Int. Cl.
*A47H 1/10* (2006.01)
*A47H 1/13* (2006.01)
*E06B 9/17* (2006.01)

(52) U.S. Cl. ..... 248/269; 248/266; 248/267; 248/252; 248/254; 248/257; 160/323.1

(58) Field of Classification Search ..... 248/266, 248/267, 269, 252, 254, 257; 160/323.1
See application file for complete search history.

(56) References Cited

U.S. PATENT DOCUMENTS

| | | | | | |
|---|---|---|---|---|---|
| 327,839 | A * | 10/1885 | Van Kirk | 248/269 |
| 438,190 | A * | 10/1890 | Schlueter | 248/266 |
| 544,899 | A * | 8/1895 | Mohr | 248/252 |
| 705,339 | A * | 7/1902 | Giorgio | 248/269 |
| 738,720 | A * | 9/1903 | Gerth | 248/266 |
| 829,891 | A * | 8/1906 | Reynolds | 160/110 |
| 838,181 | A * | 12/1906 | Grippin | 248/271 |
| 1,227,194 | A * | 5/1917 | Peterson | 248/267 |
| 1,236,269 | A * | 8/1917 | Cole | 248/267 |
| 1,346,233 | A * | 7/1920 | Mikolyn | 248/254 |
| 1,437,851 | A * | 12/1922 | Lange | 248/267 |
| 1,451,947 | A * | 4/1923 | Gugliuzzi | 248/266 |
| 1,499,340 | A * | 7/1924 | Bundy, Jr. | 248/269 |
| 2,013,500 | A * | 9/1935 | O'Connor | 248/269 |
| 2,371,903 | A * | 3/1945 | Maier | 248/231.85 |
| 2,480,438 | A * | 8/1949 | Bergman et al. | 248/257 |
| 2,894,710 | A * | 7/1959 | Shields | 248/265 |
| 3,730,469 | A * | 5/1973 | Shields | 248/265 |
| 4,363,459 | A * | 12/1982 | Holzer | 248/265 |
| 5,044,589 | A * | 9/1991 | Milne et al. | 248/265 |
| 5,899,424 | A * | 5/1999 | Williams, Jr. | 248/267 |
| 6,196,508 | B1 * | 3/2001 | Nijs | 248/267 |
| 7,451,956 | B2 * | 11/2008 | Bohlen | 248/265 |

* cited by examiner

*Primary Examiner*—Terrell Mckinnon
*Assistant Examiner*—Michael McDuffie
(74) *Attorney, Agent, or Firm*—Elias Borges

(57) ABSTRACT

The present invention is an adjustable mounting bracket for mounting a roller blind to a surface such that the roller blind can be quickly leveled. The bracket includes first and second plates, the first plate having apertures to permit the first plate to be mounted to the surface. The second plate has a mounting fixture formed thereon for mounting to the roller blind. To permit the second plate to move relative to the first plate, the second plate is provided with an elongated groove formed thereon, the second plate being movably mounted to the first member by a mounting element fixed to the first plate and passing through the groove. The mounting element and groove are dimensioned and configured to permit the second plate to slide between a first and a second position. The position of the second plate relative to the first plate is adjusted by an adjustable moving mechanism which is configured to precisely position the second plate between its first and second positions. The bracket further includes a visual indicator for visually indicating the relative position of the second plate relative to the first plate.

3 Claims, 5 Drawing Sheets

ADJUSTABLE MOUNTING BRACKET FOR ROLLER BLIND

FIELD OF THE INVENTION

The invention relates generally to mounting brackets for mounting a roller blind to a wall.

BACKGROUND OF THE INVENTION

Roller blinds are a popular form of window covering. Roller blinds generally consist of an elongated roller tube upon which the blind is wound. The roller tube has opposite ends and is generally provided with a roller clutch at one end and a plug at the other end. The roller clutch includes the mechanism required to raise and lower the blind by engaging a draw chord of some kind. The roller blind is mounted to a window by means of mounting brackets which secure the roller blind to the wall immediately adjacent the window or to the window frame, as the case may be. The mounting brackets generally include a mounting fixture for engaging and mounting with the clutch and/or the plug, depending on which end of the roller blind is being supported. The mounting brackets may also serve the dual use of providing a means for mounting a decorative fascia to hide the roller portion of the roller blind.

While the combination of a roller blind and mounting brackets are a popular means of providing a window covering, there are a few drawbacks with the design. Firstly, mounting the roller blind to the window (or wall adjacent the window as the case may be) requires careful measurement to ensure that the roller blind and fascia are level. If the roller blind is not exactly level (i.e. horizontal), then the blind will tend to "telescope" on the roller as it is wound up and unwound. This is not only unsightly, but it can cause the roller blind to function poorly. Where it is nearly impossible to level the roller, it is often necessary to add a length of tape to one side of the blind in order to ensure that when the blind is rolled up it winds up evenly without "telescoping". As can be imagined, this is a time consuming and tedious operation involving careful measurements and trial and error. In some cases, due to problems with the wall or window frame, it is impossible to level the roller completely, particularly if the fascia is to appear "lined up" with the window. An improved mounting bracket which permits the quick and flawless mounting of the roller blind is therefore required.

SUMMARY OF THE INVENTION

In accordance with one aspect of the present invention, there is provided a mounting bracket for adjustably mounting a roller blind to a surface such that the level of the roller blind can be adjusted quickly without requiring the bracket to be re-positioned. The mounting bracket includes first and second members, the first member configured to mount to the surface and the second member being movably mounted to the first member and movable between a first and second position. A mounting fixture is formed on the second member for mounting to the roller blind, and an adjustable moving mechanism is provided for selectively moving the second member between its first and second position.

In accordance with an other aspect of the present invention, an adjustable mounting bracket for mounting a roller blind to a surface such that the roller blind can be quickly leveled. The bracket includes first and second plates, the first plate having apertures to permit the first plate to be mounted to the surface. The second plate has a mounting fixture formed thereon for mounting to the roller blind. To permit the second plate to move relative to the first plate, the second plate is provided with an elongated groove formed thereon, the second plate being movably mounted to the first member by a mounting element fixed to the first plate and passing through the groove. The mounting element and groove are dimensioned and configured to permit the second plate to slide between a first and a second position. The position of the second plate relative to the first plate is adjusted by an adjustable moving mechanism which is configured to precisely position the second plate between its first and second positions.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
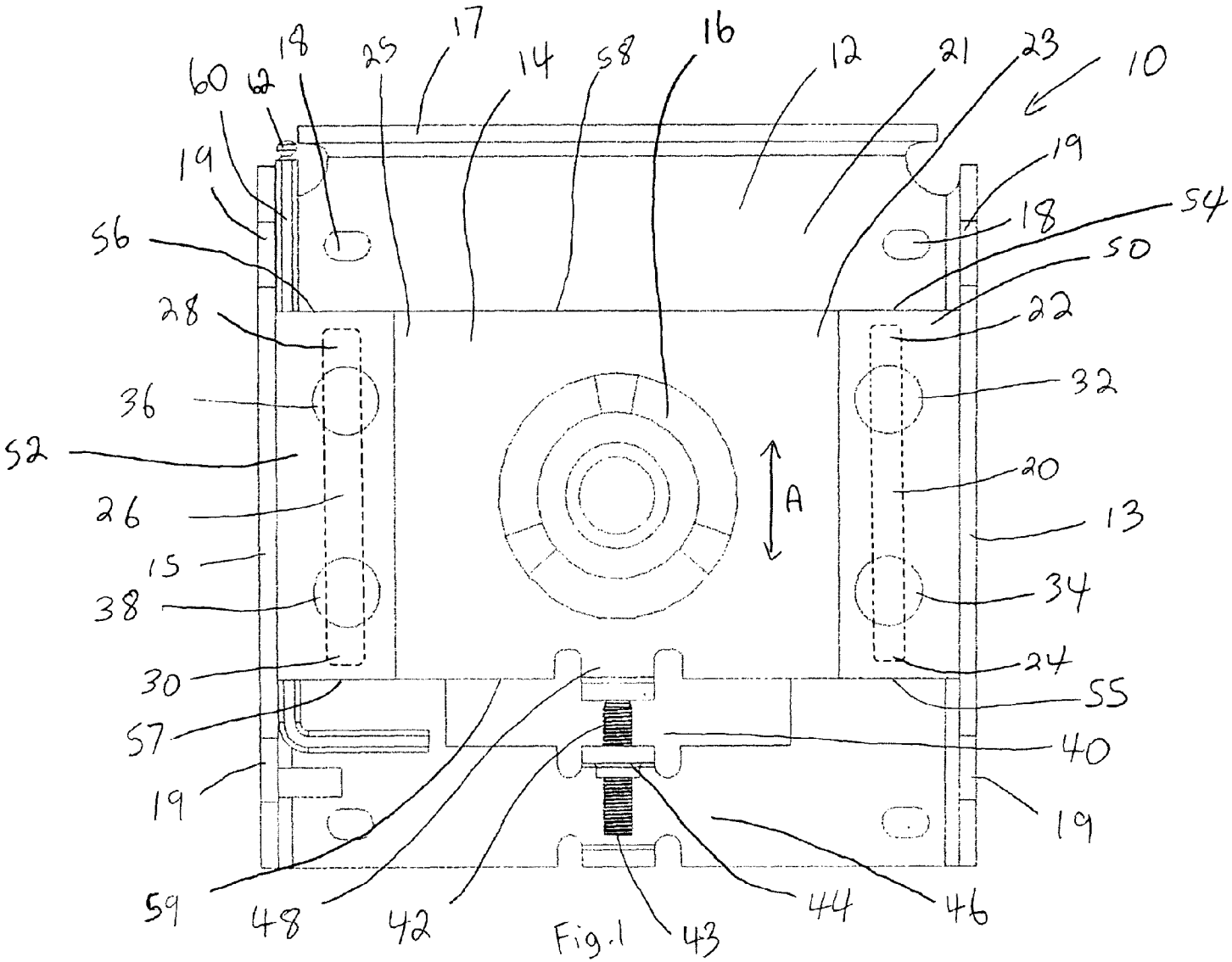
FIG. 1. is a front view of a mounting bracket made in accordance with the invention showing the movable mounting plate in a position between its first and second position.

Referring firstly to FIG. 1, a support bracket for use with a roller blind is shown generally as item 10 and consists of a base bracket 12 and a movable mounting bracket 14 movable mounted to the base bracket. Bracket 14 has mounting fixture 16 which is dimensioned and configured to mount to and support the end of a roller blind (not shown). Preferably, fixture 16 is configured to mount to both the clutch end of the roller blind (not shown) or to the plug end of the roller blind (not shown).

Figure 2:
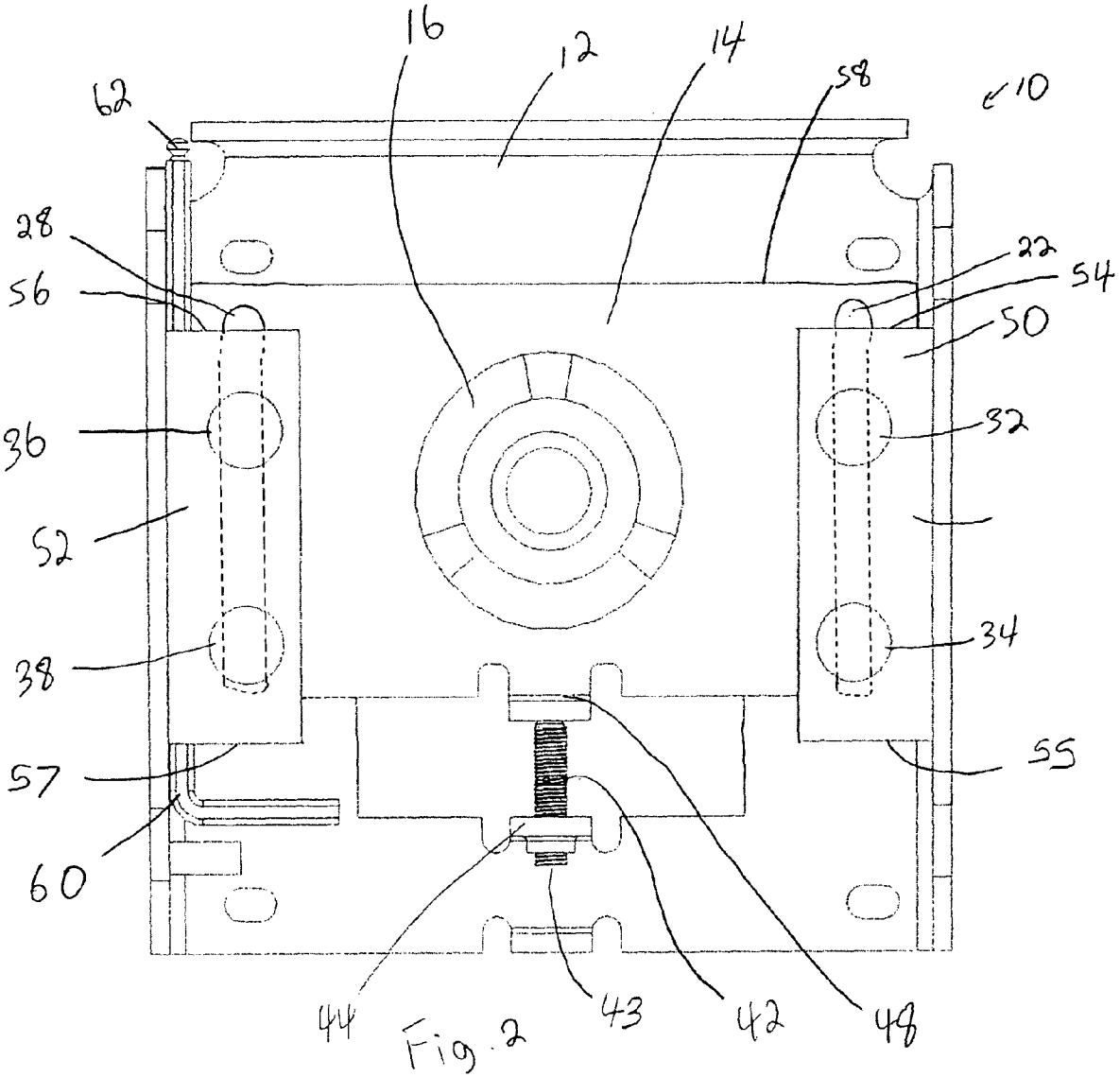
FIG. 2. is a front view of the mounting bracket shown in FIG. 1 showing the movable mounting plate in its first position.
Figure 3:
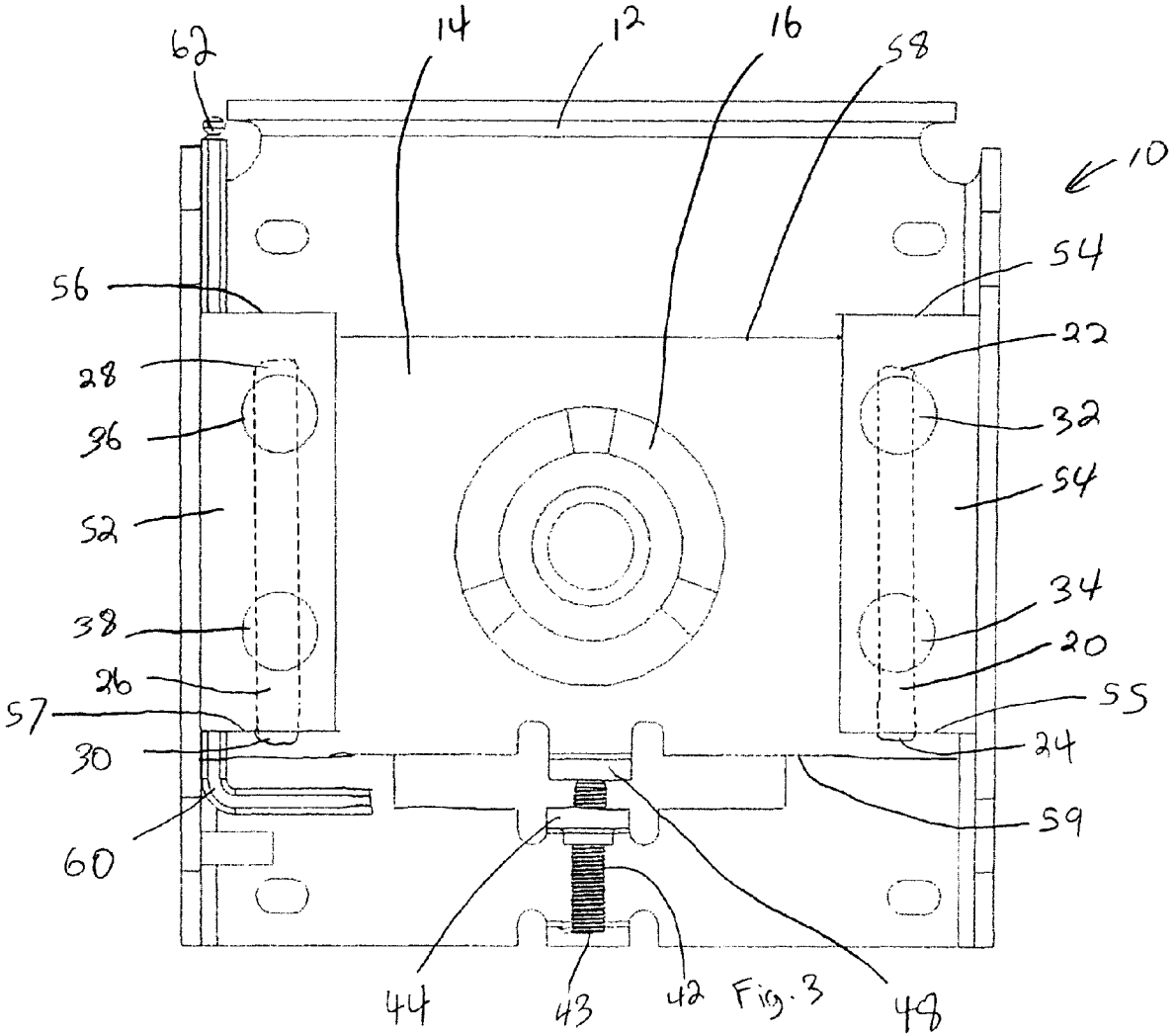
FIG. 3 is a front view of the mounting bracket shown in FIG. 1 showing the movable mounting plate in its second position.
Figure 4:
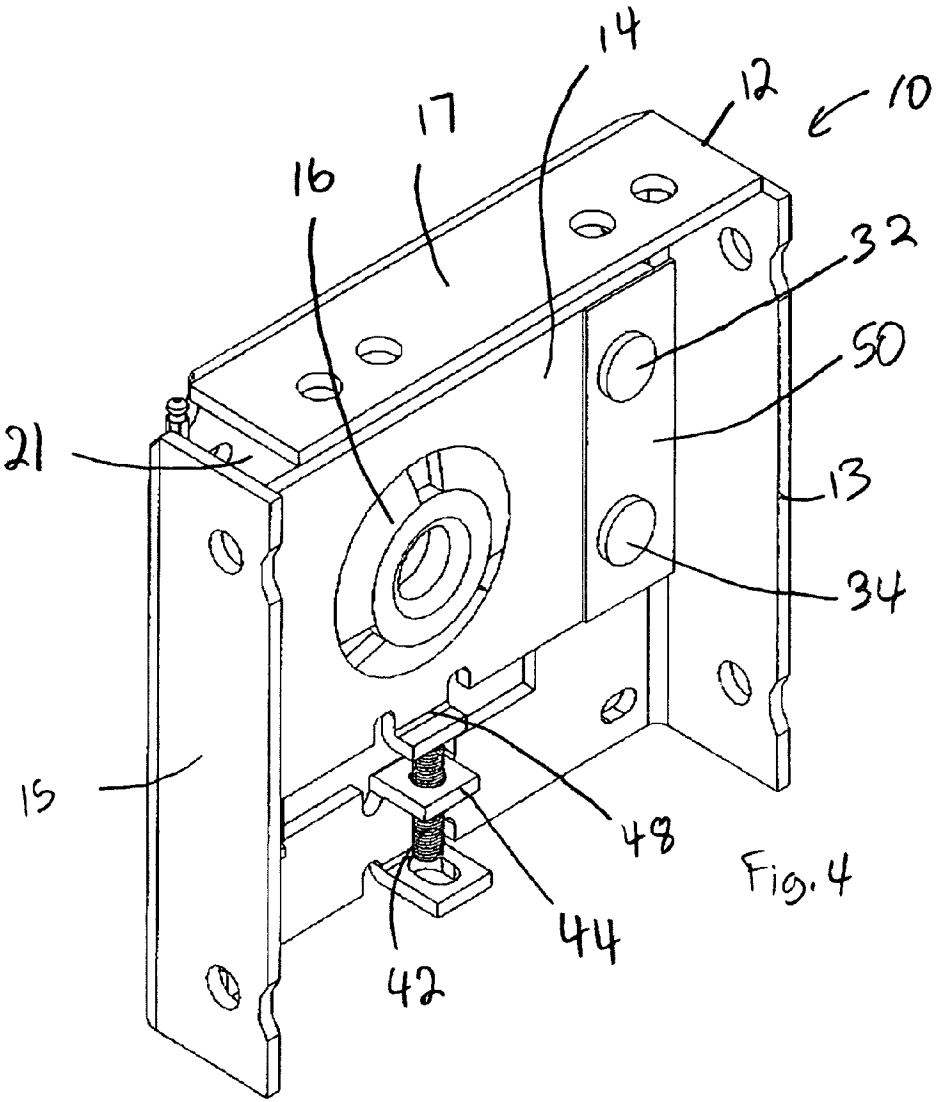
FIG. 4 is a perspective view of the invention.
Figure 5:
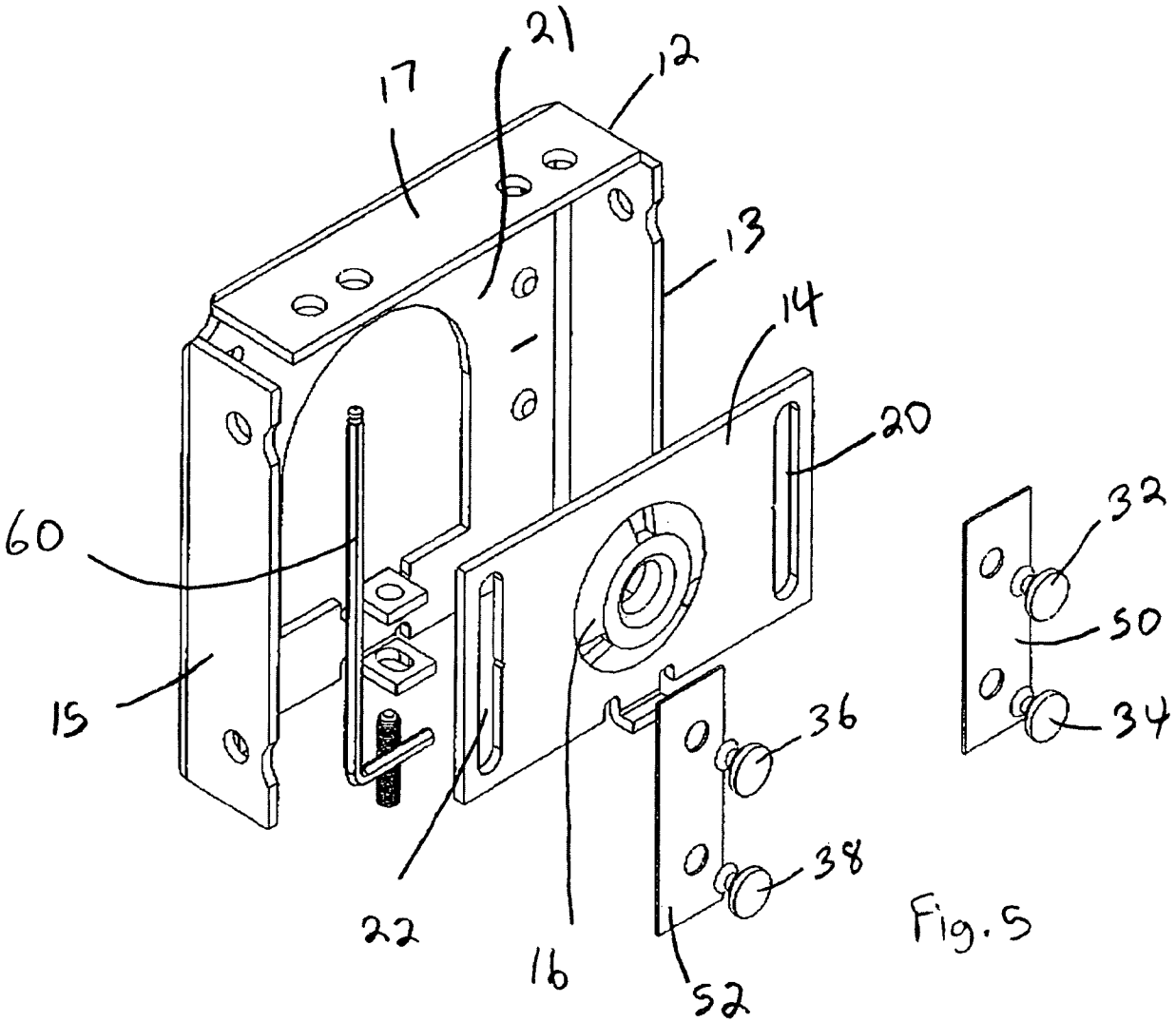
FIG. 5 is an exploded view of the invention.

Base bracket 12 is provided with sides 13 and 15 and top 17 and back 21. Sides 13 and 15 and top 17 provide bracket 12 with structural strength. Preferably, bracket 12 is made of stamped steel or some other suitably strong material. Apertures 18 and 19 are provided on bracket 12 to permit the bracket to be mounted to a wall (not shown) by means of mounting screws (not shown). Mounting bracket 14 is movably mounted to bracket 12 by means of rivets 32, 34, 36 and 38. Bracket 14 is essentially a flat metal plate having side portions 23 and 25. Elongated grooves 20 and 26 formed on side portions 23 and 25, respectively. Groove 20 has opposite ends 22 and 24 and groove 26 has opposite ends 28 and 30. Rivets 32 and 34 are fixed to bracket 12 and to plastic gasket 50 and pass through groove 20. Likewise, rivets 36 and 38 are fixed to bracket 12 and to plastic gasket 52 and pass through groove 52. Rivets 32, 34, 36 and 38 are dimensioned and configured such that bracket 14 can move up and down in the direction indicated by arrow A between a first position as shown in FIG. 2 and a second position as shown in FIG. 3.

Movable mounting plate 14 has top edge 58, bottom edge 59 and side edges 23 and 25 having grooves 20 and 26, respectively. Grooves 20 and 26 are elongated and run essentially the full width of plate 14 between edges 58 and 59. Plate 14 has a butt portion 48 which is configured to butt against adjustment bolt 42. Plate 12 has adjustment mechanism 46 which consists of adjustment bolt 42 mounted to threaded bracket 44. End 43 of adjustment bolt 42 is configured to receive end 62 of allen key 60 to permit a user to adjust the position of plate 14 simply by turning bolt 42 with the allen key.

Plastic gasket 50 has upper and lower edges 54 and 55, respectively, and gasket 52 has upper and lower edges 56 and 57, respectively. Gaskets 50 and 52 form an indicator indicating the relative position of plate 14. The upper and lower edges of gaskets 50 and 52 provide a quick visual means to determine the relative position of plate 14. Plates 14 are set at a neutral position as shown in FIG. 1 with edges 56 and 54 of gaskets 52 and 50, respectively, level with top edge 58 and with lower edges 57 and 55 of gaskets 52 and 50, respectively, level with bottom edge 59 of plate 14. When the plate is moved towards its first position, as shown in FIG. 2, top edge 58 is raised above top edges 56 and 54. Since mounting fixture 16 is formed on plate 14, the distance separating top edge 58 from top edges 56 and 54 is the distance by which fixture 16 has been elevated. Likewise, when plate 14 is moved towards its second position, as shown in FIG. 3, bottom edge 59 projects lower than bottom edges 57 and 55. The distance separating bottom edge 59 from bottom edges 57 and 55 is equal to the distance fixture 16 has been lowered by.

Gaskets 52 and 50 are spaced away from plate 12 by a distance sufficient to accommodate movable mounting bracket (plate) 14. The space separating plate 12 and gaskets 52 and 50 is also sufficient to accommodate allen key 60, so that the key can be stored within bracket 10 until it is needed for adjusting the relative position of fixture 16.

To use the mounting bracket of the present invention to mount a roller blind (not shown), the user first mounts a pair of brackets to the wall or window frame as required. The roller blind may then be installed to determine if it will be level. If the roller blind is not level, the user simply uses allen key 60 to adjust the height of movable bracket 14 in one or both of the mounting brackets as required. Brackets 10 do not have to be repeatedly repositioned on the wall or window frame. Furthermore, the roller blind can be repeatedly tested in order to make fine adjustments to the level of the roller blind (not shown) by adjusting bolt 42. In this way, the level of the roller blind can be adjusted precisely in a quick and efficient manner. The fascia can then be mounted to the plate.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A mounting bracket for mounting a roller blind to a surface, the mounting bracket comprising;

a first and a second members, the first member configured to mount to the surface and the second member being movably mounted to the first member and movable between a first and second position;

a mounting fixture formed on the second member for mounting to the roller blind, and an adjustable moving mechanism for selectively moving the second member between its first and second position;

the first and second members comprise first and second plates, the second plate having an upper edge and a lower edges and opposite first and second side portions, the second plate having first and second grooves formed on the first and second side portions, respectively, the first and second plates being mounted to each other by rivets fixed to the first plate and passing through the grooves in the second plate, the rivets and grooves being dimensioned and configured to permit the second plate to move between its first and second positions by sliding;

the adjustable moving mechanism comprising a threaded bolt threaded to a bracket formed on the first plate, the bolt abutting a butt formed on the second plate, the position of the second plate relative to the first plate being adjusted by turning the bolt, and further comprising an indicator for indicating the relative position of the second plate, said indicator comprising an elongated member mounted onto the second member, the elongated member being fixed in place by attachment to the rivets, the elongated member having opposite upper and lower edges, the elongated member being dimensioned and configured such that the upper edge of the elongated member aligns with the upper edge of the second plate and the lower edge of the elongated member aligns with the lower edge of the second plate when the second plate is at a neutral position between its first and second positions.

2. The mounting bracket of claim 1 wherein the bolt has an end adapted and configured to mate with an adjustment member for turning the bolt, the bracket being further configured to store the adjustment member within the bracket.

3. A mounting bracket for mounting a roller blind to a surface, the mounting bracket comprising;

a first and a second plates, the first plate having apertures to permit the first plate to be mounted to the surface;

the second plate having a mounting fixture formed thereon for mounting to the roller blind;

the second plate also having an elongated groove formed thereon, the second plate being movably mounted to the first plate by a mounting element fixed to the first plate, the mounting element passing through the groove, the mounting element and groove being dimensioned and configured to permit the second plate to slide between a first and a second position;

an adjustable moving mechanism for selectively adjusting the position of the second plate between its first and second position;

the second plate having opposite upper and lower edges and opposite sides, the second plate having a pair of parallel elongated grooves, each side having one of said grooves;

the adjustable moving mechanism comprising a threaded bolt threaded to a bracket formed on the first plate, the bolt abutting a butt formed on the second plate, the position of the second plate relative to the first plate being adjusted by turning the bolt;

an indicator for indicating the relative position of the second plate;

the first and second plates being mounted to each other by rivets fixed to the first plate and passing through the grooves in the second plate, the rivets and grooves being dimensioned and configured to permit the second plate to move between its first and second positions by sliding, wherein the indicator comprises an elongated member mounted onto the second plate, the elongated member being fixed in place by attachment to the rivets, the elongated member having opposite upper and lower edges, the elongated member being dimensioned and configured such that the upper edge of the elongated member aligns with the upper edge of the second plate and the lower edge of the elongated member aligns with the lower edge of the second plate when the second plate is at a neutral position between its first and second positions.

* * * * *